United States Patent [19]

Eguchi

[11] Patent Number: 4,459,928

[45] Date of Patent: Jul. 17, 1984

[54] HEMMING BY ZIGZAG SEWING MACHINE

[75] Inventor: Yasukata Eguchi, Kunitachi, Japan

[73] Assignee: Janome Sewing Machine Co. Ltd., Tokyo, Japan

[21] Appl. No.: 393,360

[22] Filed: Jun. 29, 1982

[30] Foreign Application Priority Data

Jul. 7, 1981 [JP] Japan ..... 56-105039

[51] Int. Cl.[3] ..... D05B 1/20

[52] U.S. Cl. ..... 112/268.1; 112/235; 112/433

[58] Field of Search ..... 112/177, 268.1, 269.1, 112/162, 158 R, 235, 433

[56] References Cited

U.S. PATENT DOCUMENTS 585,939 7/1897 Plumley ..... 112/269.1 X 4,250,824 2/1981 Meier et al. ..... 112/162 X

FOREIGN PATENT DOCUMENTS 1195584 6/1965 Fed. Rep. of Germany ..... 112/162

*Primary Examiner*—Werner H. Schroeder

*Assistant Examiner*—Andrew M. Falik

*Attorney, Agent, or Firm*—Michael J. Striker

[57] ABSTRACT

A fabric presser foot containing a member for guiding the hem of a fabric and a thread guide member disposed externally to the hem guide member and parallel to the fabric feed direction. Hemming is accomplished with the presser foot by forming a series stitch and a stitch for the subsequent stitching cycle. The series stitch contains at least two stitches formed on the fabric. Also formed is a stitch at the fabric hem, and a stitch formed externally to the thread guide member which is disposed on the fabric presser foot. The presser foot is attached to the head of the zigzag sewing machine which forms lock stitches using an upper and lower thread.

5 Claims, 12 Drawing Figures

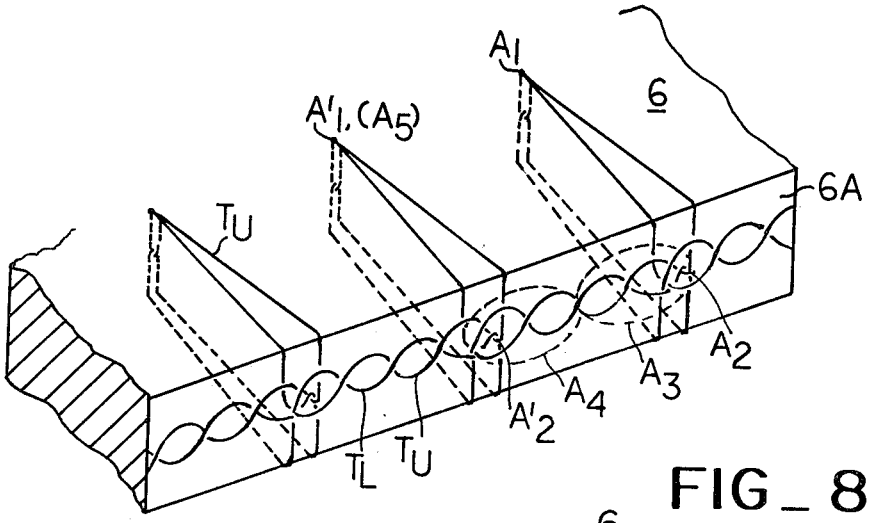
FIG_6
FIG_8
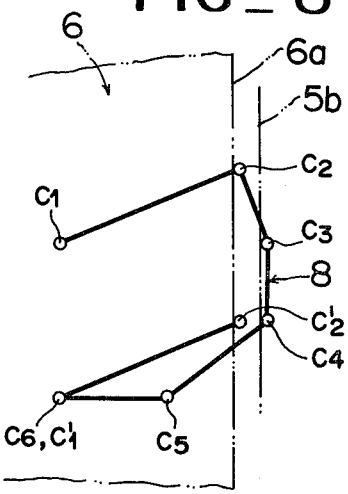
FIG_7
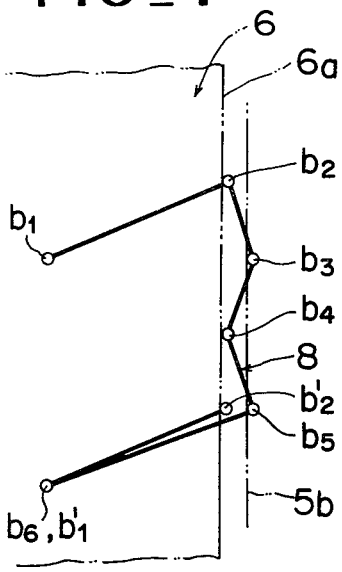
FIG_9
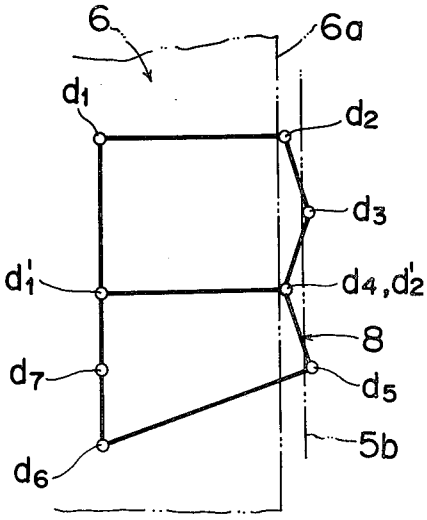

HEMMING BY ZIGZAG SEWING MACHINE

BACKGROUND OF THE INVENTION

This invention relates to a home hemming method to be carried out with a hemming device by a zigzag sewing machine, and more particularly to a home hemming method performed with the hemming device for producing hemmings using an upper thread and a lower thread as opposed to hemming by an overlock sewing machine or an interlock sewing machine.

Fabric weaving threads are easily frayed, and the fraying spoils the outer appearance of the fabric product and reduces the functioning value of the sewn product. Therefore, in order to prevent such disadvantages, various kinds of hemmings have been performed. The overlock sewing machine or the interlock sewing machine are preferred since they can produce hemmed stitches extensively and rapidly. However, these sewing machines are exclusively used for one function and are expensive. Although these sewing machines should be used for all forms of stitching, it is uneconomical to provide them for use in the home.

Generally, the hemming is performed by the zigzag sewing machine utilizing a single needle that runs along the fabric hem. Since in this way there is no thread formation covering the fabric hem, the hemming effect and the outer appearance of the hemmed stitches are inferior to those obtained by the professional machines such as the zigzag sewing machine.

Under such conditions the hemmings of high quality can not be produced.

SUMMARY OF THE INVENTION

The present invention removes the disadvantages involved in the state of the art.

An object of the present invention is to produce the hemmed stitches comparable with those obtained by the overlock sewing machine or the interlock sewing machine by providing a device for the fabric presser foot that is incorporated with the zigzag sewing machine and will form the lock stitches with upper and lower threads.

Briefly stated there is provided a method to hem a fabric using the zigzag sewing machine to form stitches containing an upper thread and a lower thread. This is accomplished by forming a series stitch formed with at least two stitches on the fabric, a stitch formed at the fabric hem, and a stitch formed outside of the thread guide member which is disposed on the fabric presser foot which is attached to the machine head and positioned outside of the fabric, and further a stitch of a subsequent stitching cycle within the series stitch. Furthermore, the device of the present invention is provided with a member for guiding the fabric hem to the fabric presser foot which is attached to the head of the zigzag sewing machine, and forms lock stitches with the upper and lower threads, and contains a thread guide member disposed outside of the guide member parallel to the fabric feed direction.

The novel features which are considered as characteristic for the invention are set forth in particular in the appended claims. The invention itself, however, both as to its construction and its method of operation, together with additional objects and advantages thereor, will be best understood from the following description of specific embodiments when read in connection with the accompanying drawing.

BRIEF DESCRIPTION OF THE DRAWINGS

FIG. 6 is a perspective view of the hemming shown in FIG. 5;

FIGS. 7, 8 and 9 depict patterns of the hem-stitching of alternate embodiments of the present invention.

DETAILED DESCRIPTION OF THE PREFERRED EMBODIMENTS

Figure 1:
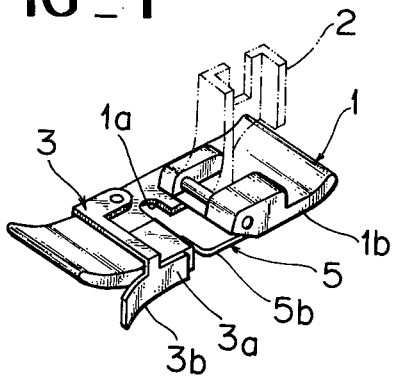
FIG. 1 is a perspective view of the device for carrying out the method according to the invention.
Figure 2:
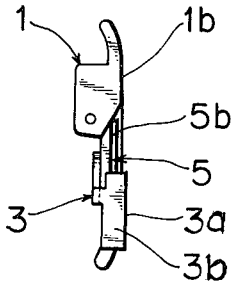
FIG. 2 is an elevational view of the device shown in FIG. 1.
Figure 3:
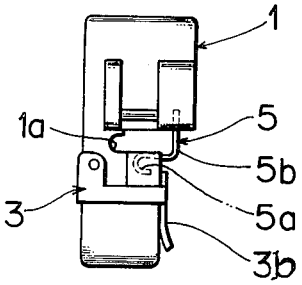
FIG. 3 is a plan view of the device shown in FIG. 1.

The present invention will be explained with reference to the accompanying drawings. A presser foot 1 is pivotally mounted to a presser holder 2 which is fixed to a lower end of a presser bar (not shown) which is attached to a machine head (not shown). The presser foot 1 contains a needle dropping hole l*a* in its center, and is securred at its front portion to a fabric guide member 3 which is made of an elastic material. The fabric guide member 3 is formed with a fabric guide portion 3*a* which extends at its bottom 3*b* outwardly from the surface bottom 1*b* of the presser foot 1. The bottom 3*b* is disposed parallel to the fabric feed direction. A thread guide member 5 includes a heat treated steel wire and has one end 5*a* (FIG. 3) affixed to the front part of the presser foot 1, while the other end formed with a guide portion 5*b* is outside of the thread guide portion 3*a*, parallel to the fabric feed direction and transversely to the extension of the needle drop. The bottom of the thread guide portion 5*b* is offset to the bottom 16 of the presser foot 1.

Figure 4:
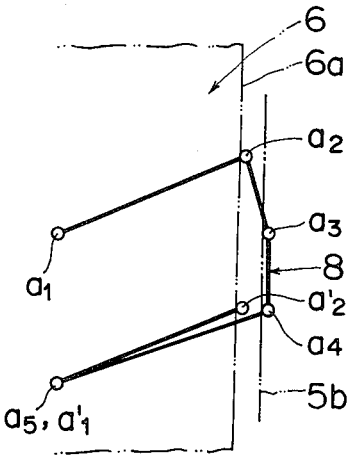
FIG. 4 depicts a pattern of hem-stitching.
Figure 5:
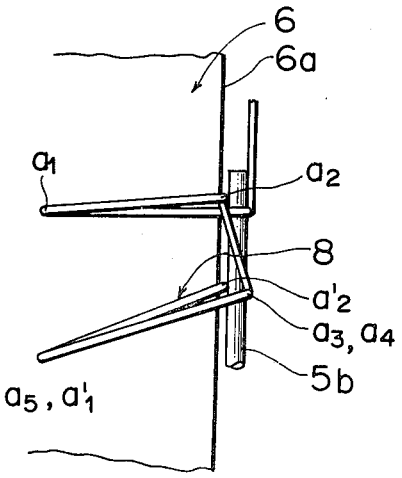
FIG. 5 shows hemming using the pattern shown in FIG. 4.

FIG. 4 shows one example of a hemming pattern obtained by utilizing the device of the present invention. This pattern may be stored electronically in a microcomputer (not shown) of the conventional zigzag sewing machine or may be accomplished mechanically by using a pattern cam (not shown) of the zigzag sewing machine. Stitches a1, a5 are formed on the fabric 6, stitch a2 is formed at a hem 6*a* of the fabric, and stitches a3, a4 are formed outside of the thread guide portion 5*b* of member 5. Thus the stitches a1, a3, a4 and a5 make up one hemming cycle. The hemming is carried out while the fabric guide member portion 3*a* touches the hem 6*a* of the fabric 6. A stitch a2′ of a next cycle is formed within a series stitch (FIG. 5) which is made up of the stitches a1, a2, a3, a4, and a5 of the previous cycle. The hem 6*a* of the fabric 6 utilizes the hemming as shown in FIG. 6 where Tu is the upper thread and $T_L$ is the lower thread. $T_L$ forms the hemming along the hem 6*a* of the fabric 6 producing a hem-stitching similar to that formed by an overlock sewing machine.

Figure 10:
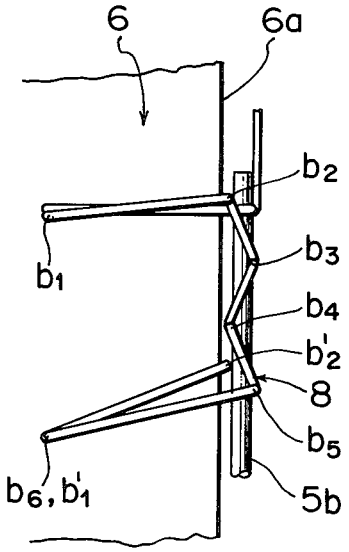
FIGS. 10, 11 and 12 show hemmings utilizing the patterns shown in FIGS. 7, 8 and 9 respectively.
Figure 11:
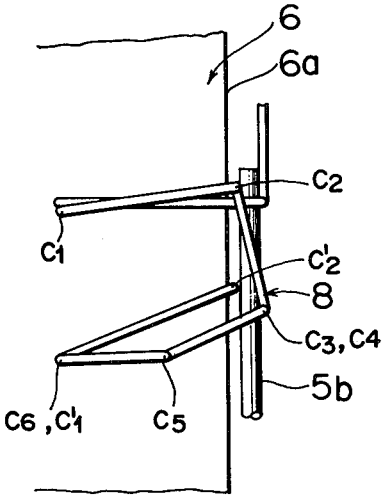

FIGS. 7 to 9 show other examples of the hemming patterns formed by the present invention and FIGS. 10 and 11 respectively show hemmings produced by these pattens.

In FIG. 7, the stitches b1, b6 are shown on the fabric 6, the stitches b2, b4 are at the hem 6*a* of the fabric 6, the stitches b3, b5 are outside of the thread guide member portion 5*b*, and stitches b'1, b'2 show a portion of the hemming formed by a subsequent cycle.

FIG. 10 shows hemming utilizing the pattern of FIG. 7, in which the stitch b'2 is within the series stitch 8.

In FIG. 8, the stitches c1, c5, c6 are on the fabric 6, the stitch c2 is at the hem 6*a* of the fabric 6, the stitches c3, c4 are outside of the thread guide member portion 5*b*, and stitches c'1, c'2 show a part of the hemming formed by a subsequent cycle. FIG. 8 shows the stitch formed by the pattern shown in FIG. 11 in which the stitch c'2 is within the series stitch 8.

In FIG. 9, the stitches d1, d6, d7 are on the fabric 6, the stitches d2, d4 are at the hem 6*a* of the fabric 6, the stitches d3, d5 are outside of the thread guide member 5*b*, and stitches d'1, d'2 show a portion of the hemming formed by a subsequent cycle.

Figure 12:
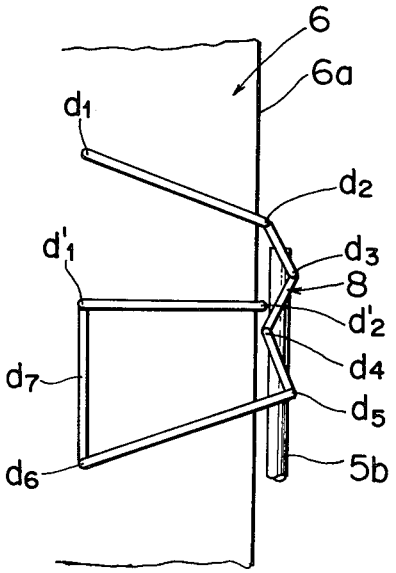

FIG. 12 shows hemming formed by the pattern shown in FIG. 9. Since folded cloth is hemmed together on the fabric 6, the hemming is comparable to the hemming of the interlock sewing machine. In this instance, the stitch d'2 is within the series stitch 8.

The stitches according to the present invention are formed as described above. The zigzag sewing machine produces a locking stitch with upper and low threads. The presser foot is constructed so that the stitches are comparable with those produced by the overlock sewing machine or the interlock sewing machine allowing hem-stitches of high quality to be produced in the home.

It will be understood that each of the elements described above, or two or more together, may also find a useful application in other types of constructions differing from the types described above.

While the invention has been illustrated and described as embodied in a home hemming zigzag sewing machine, it is not intended to be limited to the details shown, since various modifications and structural changes may be made without departing in any way from the spirit of the present invention.

Without further analysis, the foregoing will so fully reveal the gist of the present invention that others can, by applying current knowldege, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of hemming a fabric by means of a zigzag sewing machine which forms locking stitches with an upper thread and a lower thread and has a machine head, the method comprising the steps of providing a presser foot attached to the machine head and having a needle dropping hole; providing a fabric guide member on said presser foot for guiding the hem of the fabric to be sewn during the hemming; providing a thread guide member connected to the presser foot and disposed outside of the fabric guide member and in parallel to a fabric feed direction; and forming a plurality of subsequent series stitches of a predetermined cycle; wherein the forming step of an individual series stitch includes producing at least two stitches on the fabric to be sewn, producing at least one stitch at the fabric hem and producing at least one stitch outside of said thread guide member, a stitch at the fabric hem of each subsequent series stitch being located within a previous series stitch.

2. The method as defined in claim 1, wherein two stitches are produced outside of the thread guide member in the step of forming an individual series stitch.

3. The method as defined in claim 2, wherein two stitches are produced at the hem of the fabric in the step of forming an individual series stitch.

4. The method as defined in claim 3, wherein three stitches are produced on the fabric to be sewn in the step of forming an individual series stitch

5. The method as defined in claim 1, wherein three stitches are produced on the fabric to be sewn in the step of forming an individual series stitch.

* * * * *